United States Patent [19]

Ajioka et al.

[11] Patent Number: 4,613,869

[45] Date of Patent: Sep. 23, 1986

[54] ELECTRONICALLY SCANNED ARRAY ANTENNA

[75] Inventors: James S. Ajioka, Fullerton; James V. Strahan, Yorba Linda, both of Calif.

[73] Assignee: Hughes Aircraft Company, Los Angeles, Calif.

[21] Appl. No.: 562,499

[22] Filed: Dec. 16, 1983

[51] Int. Cl.[4] ..... H01Q 13/10

[52] U.S. Cl. ..... 343/768; 343/771; 343/777; 343/371

[58] Field of Search ..... 343/768, 770, 787, 771, 343/756, 776, 777, 778, 785, 371; 333/21 A, 24.1, 24.3, 135

[56] References Cited

U.S. PATENT DOCUMENTS

| | | | |
|---|---|---|---|
| 2,808,584 | 10/1957 | Kock | 343/768 |
| 3,004,259 | 10/1961 | Shanks et al. | 343/768 |
| 3,328,800 | 6/1967 | Algeo | 343/768 |
| 3,471,857 | 10/1969 | Schwartz | 343/771 |
| 3,618,108 | 11/1971 | Buck | 343/778 |
| 3,753,160 | 8/1973 | Safran | 333/21 A |
| 3,855,597 | 12/1974 | Carlise | 343/768 |
| 3,938,158 | 2/1976 | Birch et al. | 333/21 A |
| 4,382,261 | 5/1983 | Freibergs et al. | 343/854 |
| 4,389,650 | 6/1983 | Stern | 343/768 |
| 4,491,845 | 1/1985 | Rothenberg | 343/778 |

FOREIGN PATENT DOCUMENTS 1576447 4/1968 France .

1005221 5/1962 United Kingdom .

OTHER PUBLICATIONS

M. I. Skolnik, "Introduction to Radar Systems", Second Edition, 1980, McGraw-Hill, pp. 291-297.

Horn, Jacobs, Freibergs, and Klohn, "Electronic Modulated Beam-Steerable Silicon Waveguide Array Antenna," IEEE Transactions on Microwave Theory and Techniques, vol. MTT-28, No. 6, Jun. 1980, pp. 647-653.

*Primary Examiner*—Eli Lieberman

*Assistant Examiner*—Michael C. Wimer

*Attorney, Agent, or Firm*—T. A. Runk; A. W. Karambelas

[57] ABSTRACT

An electronically scanned array antenna useful for millimeter wavelength energy is disclosed. The antenna comprises a fully ferrite loaded square or round waveguide having radiating apertures spaced along part of its length. Rf energy is circularly polarized in the waveguide. The phase velocity of the wave is controlled by applying a longitudinal magnetic field to the ferrite to produce a controllable linear progressive phase of the energy radiated from the apertures to form a beam in the desired direction. The phase control is of a latching type using flux drive. The particular structure of the invention enables combining a plurality of branching array elements with a feed element to form an array capable of two dimension beam scanning.

30 Claims, 12 Drawing Figures

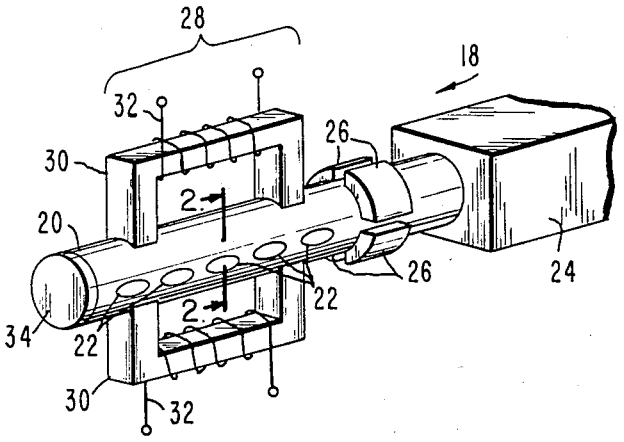
Fig. 1.
Fig. 2.
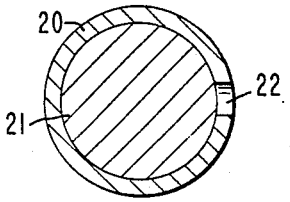
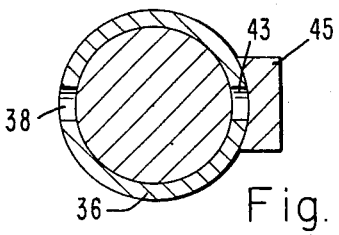
Fig. 3c.
Fig. 3a.
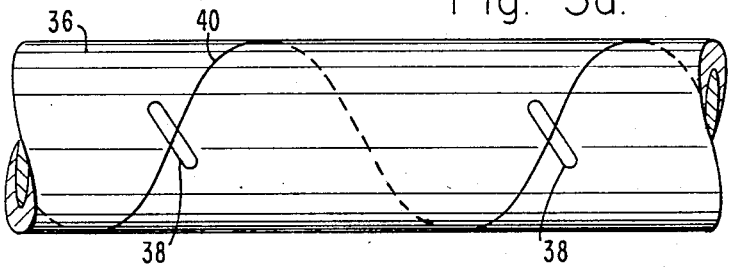
Fig. 3b.
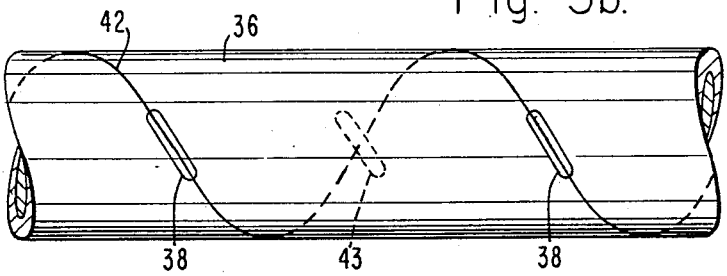

ELECTRONICALLY SCANNED ARRAY ANTENNA

BACKGROUND OF THE INVENTION

The invention relates to the field of antennas, and more particularly to electronically scanned antennas capable of operating at high frequencies including the millimeter wavelength energy regions.

The small size, narrow beamwidths and high resolution of millimeter wavelength antennas make them desirable for many applications. However, due to the narrow beamwidths associated with these antennas, a large number of beam positions is required to cover the same surveillance volume as lower frequency antennas. This may require thousands of radiating elements with associated connectors, dividers, couplers, transmission lines and where scanning is a required antenna function, phase shifters. Due to the short wavelength of this energy, the elements involved are physically very small and maintaining manufacturing tolerances becomes difficult. At a frequency of 60 GHz and higher, the components are typically extremely small and difficult to accurately, consistently and practically reproduce. Fabricating and assembling these components also pose large cost considerations.

At lower frequencies, individual phase shifters have been employed. One phase shifter for each radiating element is used in a typical antenna, and a phased array may include hundreds or even thousands of such elements spaced one-half wavelength apart, for example. At a frequency such as 60 GHz, the use of individual phase shifters becomes difficult for the reasons discussed above.

A prior technique for a millimeter wavelength antenna is found in R. E. Horn, H. Jacobs, E. Freibergs and K. L. Klohn, "Electronic Modulated Beam-Steerable Silicon Waveguide Array Antenna", IEEE Transactions, MTT, Vol. MTT28, No. 6, June 1980, pp. 647–653. In this technique, a silicon rod with a metallic grate on one surface and distributed PIN diodes on an adjoining surface are stated to be operable near 60 GHz. This technique is apparently limited in usefulness, however, in that relatively high rf losses occur with this structure (page 651); the scan range is relatively small (approximately 10°, page 649); the ability to continuously scan the beam is doubtful (page 650); and the technique is complex.

Another technique involves using ferrite phase shifters as radiators. An antenna using this technique is found in U.S. Pat. No. 3,855,597 to Carlise. Ihis antenna uses a partially ferrite loaded, slotted waveguide for electronic scanning. The waveguide is loaded with ferrite sections which coincide with radiating slots in the waveguide. This approach is a modified Reggia-Spencer type phase shifter and retains most of the problems of the Reggia-Spencer approach.

In the Carlise technique as in general in Reggia-Spencer type radiators, the discontinuities between the empty, or dielectric portions of the waveguide and the ferrite portions permit undesirable higher order modes. A holding current is required of the control coils to keep the beam pointing in a given direction and the magnitude of this holding current must be very accurately controlled or the antenna beam will scan off the given direction. This holding current requirement puts a severe drain on the control current power supply. Latching yokes have not been used since the ferrite does not fill the waveguide. The dielectric or air gaps in the magnetic field path present such a large impedance to the magnetic field generation circuit that phase control coils wound around the waveguide adjacent to the radiating slot have been used. The proximity of these coils to the slot can result in the coupling of the radiated rf energy into the control coils thereby causing rf loss and antenna pattern degradation. Since the ferrite is not in contact with a thermally conductive material such as the waveguide, cooling is effected by radiation unless an additional cooling apparatus is attached. Heat dissipation techniques for cooling the ferrite rod, other than radiation only, have entailed physical difficulties. Manufacturing difficulties exist in accurately and consistently assembling the ferrite sections with air or dielectric spacers in between, supporting this ferrite/spacer rod inside the waveguide, and maintaining consistency in the windings between each radiating waveguide aperture.

SUMMARY OF THE INVENTION

It is a purpose of the invention to provide an electronically scanned antenna which overcomes the above discussed problems and other problems with prior techniques. It is also a purpose of the invention to provide an electronically scanned antenna which can operate at high frequencies including the millimeter wavelength energy regions and which is simpler in construction, more consistently and accurately reproducible, more easily manufactured and less expensive to manufacture than prior techniques.

Another purpose of the invention is to provide an antenna in which the angle of scan can be accurately controlled, in which there is a relatively large scan range and in which the antenna is continuously scannable through its scan range.

Another purpose of the invention is to provide an antenna which reduces higher order moding problems as a result of its structure and uses less power for operation than prior techniques.

Another purpose of the invention is to provide an antenna which can handle relatively high average power levels and which is more easily cooled than prior techniques.

Another purpose of the invention is to provide an antenna which is usable in an antenna array and which also makes fabrication of such an array simpler, more accurate and less expensive.

These purposes and other purposes are attained by the invention wherein there is provided a phase shift apparatus and control, radiating apertures, and rf energy distribution to the radiating apertures in a single structure.

The phase shifting apparatus and control are based on the principle of a Faraday rotator and use a longitudinally oriented magnetic field in ferrite to rotate the circularly polarized rf energy which propagates through the ferrite, thus imparting the desired phase shift. This phase shifting apparatus is a latching type and flux drive is used for accurate phase shift control. The electromagnetic energy is circularly polarized in the ferrite by a quarter wave plate or other suitable means before phase shift control is applied.

A waveguide having radiating apertures is fully filled with the phase shifting ferrite material. Radiation of electromagnetic energy occurs through the apertures at an angle determined by the applied longitudinal magnetic field as well as by various other factors such as frequency of the electromagnetic energy, position of the apertures in the ferrite filled waveguide, spacing of the apertures from each other, etc.

The magnetic field is generated and applied by a yoke or yokes attached to the ferrite phase shifting apparatus. This yoke is also constructed of a ferrite material and is attached to the phase shifting ferrite at points chosen for scanning angle control. Around the control yoke or yokes are wound control coils for generating a magnetic field. Application of current drive pulses to the control coils causes a magnetic field to be applied to the ferrite filled waveguide through the magnetic circuit created by the control yoke or yokes.

Advantage is taken of the dielectric constant of the waveguide ferrite by locating the radiating apertures at loaded waveguide wavelength intervals. This aperture spacing will be less than one-half free space wavelength and has the result of reducing extraneous lobes (grating lobes) no matter how far the main beam is scanned.

Other purposes, features and advantages of the invention will be apparent, and a better understanding of its construction and operation will be gained from the following detailed description taken in view of the accompanying drawings.

BRIEF DESCRIPTION OF THE DRAWINGS

FIG. 1 is a perspective view of a scanning antenna in accordance with the invention, using circular waveguide;

FIG. 2 is a cross-section view along section lines 2—2 of FIG. 1;

FIG. 3*a* is a diagrammatical view showing the instantaneous rf current flow lines in the waveguide walls that are associated with left-hand circularly polarized energy in a circular waveguide;

FIG. 3*b* is the diagrammatical view as FIG. 3*a* except that right-hand circularly polarized energy is shown and a coupling aperture has been added;

FIG. 3*c* is a cross-sectional view of the waveguide shown in FIG. 3*b*, with an rf load coupled to the coupling aperture;

FIG. 3*d* shows a pair of apertures which have quadrantal symmetry; and FIG. 3*e* shows a pair of crossed slots;

DETAILED DESCRIPTION OF THE INVENTION

Figure 3D:
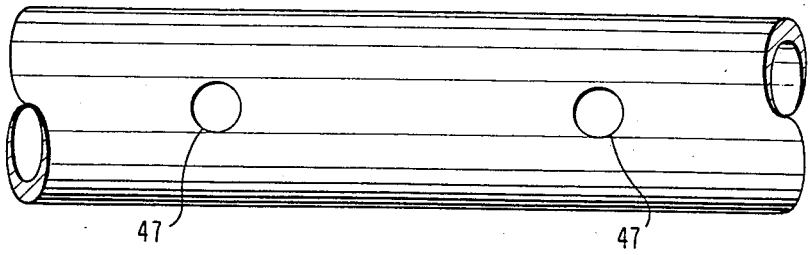
FIGS. 3*d* and 3*e* present views of different apertures where

Referring now to the drawings with more particularity, FIG. 1 depicts a perspective view of an electronically scanned antenna 18 in accordance with the invention, using circular waveguide. FIG. 2 is a cross-sectional view of FIG. 1 taken along section lines 2—2. The waveguide 20 is fully loaded with a ferrite substance 21 and apertures 22 have been formed in the waveguide wall. The waveguide 20 is coupled to a feed waveguide 24 which in this case is rectangular, and has a circular polarizer 26 which in this embodiment, consists of four magnets, preceding the phase shifting section 28 of the antenna. Yokes 30 and control coils 32 impart a selected magnetic field to the ferrite loaded waveguide 20 resulting in a phase shift of the rf energy within. An rf load 34 is coupled to the waveguide 20.

The waveguide 20 with apertures 22 therein may be fabricated in ways familiar to those skilled in the art. One well-known method is to plate a ferrite rod with gold, silver, copper, or other suitable conductive material. The metalization of the ferrite rod may be accomplished by plating or sputtering techniques and the apertures in the waveguide may be formed by etching or by laser cutting, for example.

The ferrite material 21 in the waveguide 20 has a dielectric effect as well as a phase shifting capability. The dielectric quality of the ferrite is a consideration in determining the spacing of the apertures 22 from each other in the waveguide 20 to obtain the desired radiated beam angle. Typically, ferrite material has a dielectric constant of ten or more, thus causing a one-wavelength spacing of the apertures 22 in the ferrite loaded waveguide 20 to be less than a one-half wavelength in free space. It has been found that the ferrite loading of the waveguide 20 reduces the effective wavelength in the waveguide by the square root of the effective dielectric constant of the ferrite material 21. Thus, the ferrite loaded waveguide 20 wavelength is reduced by a factor of approximately three compared to an unloaded waveguide with the same cutoff frequency. If a beam near broadside to the waveguide 20 is desired, it has been found that apertures 22 formed at approximately one wavelength intervals (loaded waveguide) when the ferrite 21 in the waveguide 20 has no magnetic field residing in it, provides a beam in that direction. This spacing of radiating elements at less than a one-half wavelength in free space gives an advantage over unloaded waveguide in regard to the radiation pattern. Extraneous lobes (grating lobes) are reduced in the radiating pattern regardless of what angle through which the beam is scanned; it has been found that the first grating lobe does not appear in real space.

The rf energy entering the phase shifting section 28 of the antenna 18 from the feed waveguide 24 is first circularly polarized. Polarizing it in a right-handed sense or a left-handed sense may affect the radiation pattern depending upon aperture orientation and shape. An aperture in the waveguide wall that "interrupts" the rf current will have an electric field excited across the aperture and will radiate. However, if the aperture does not "interrupt" the rf current, no electric field will be excited and no radiation will occur. This phenomenon permits using narrow slot apertures of the proper orientation as a filter, e.g., right-hand circularly polarized energy may be radiated while left-hand circularly polarized energy is not. An application of this to circular waveguide is shown in FIGS. 3*a* and 3*b*.

As shown in FIG. 3*a*, the circular waveguide 36 has slots 38 formed therein. These slots are oriented so as to interrupt the rf currents associated with the left-hand circularly polarized energy 40 propagating in the waveguide 36. Because the slots 38 interrupt the rf current flow, they will radiate. In FIG. 3*b*, the same waveguide 36 has the same slots 38. However, right-hand circularly polarized energy 42 is propagating in the waveguide 36. As is shown, the long dimension of the narrow slots are aligned with the rf current flow lines and substantially no radiation will occur. Thus by properly orienting the slot apertures, certain energy may be filtered from radiation while other energy is radiated.

This filtering has a beneficial effect when undesirable energy is reflected inside the antenna. If the rf current flow of this undesirable energy is oriented such that the slots do not interrupt it, this energy will not be radiated to degrade the radiation pattern. Conversely, if slots are formed in the waveguide which will interrupt those undesirable rf currents, and load devices are coupled to those slots, the undesirable energy will be coupled from those slots and absorbed by the load devices. Thus, a waveguide can be formed having two sets of slots, one set of which is for radiating the desirable energy into space while the other set is for coupling the undesirable energy into load devices. As an example, where the rf undesirable currents indicated by numeral 42 in FIG. 3*b* are to be coupled into a load device, a slot 43 could be formed in the waveguide wall diametrically opposite the slots 38. The slot 43 would be oriented such that it interrupts the undesirable rf currents 42 thereby coupling from slot 43 to an rf load device such as that shown in FIG. 3c and indicated by numeral 45. In FIG. 3*c*, the rf load device 45 is coupled directly to the coupling slot 43. Thus, energy coupled from the slot 43 will be absorbed by the load device 45. Load devices usable in this application include rf loads sold under the trademark Eccosorb by Emerson & Cuming, Canton, Mass.

Similarly, where the slots are formed in the waveguide for radiating only the desirable rf energy, as shown in FIG. 3*a*, and a load device is placed at the end of that waveguide as is shown in FIG. 1, then the undesirable energy will be at least partially absorbed as it propagates into the load device since it was not radiated by the slots.

In the discussions herein, the invention is generally referred to as being usable for radiating. However, it is to be understood that the invention is capable of both radiation and reception, and for convenience of description only, the invention and elements of it are referred to in terms of their functions in the radiation of electromagnetic energy.

Circular polarization may be accomplished by techniques known to those skilled in the art. Nonreciprocal quarter wave plates may be used, as well as an orthopolarization mode transducer with a quarterwave plate, a quadrature hybrid feeding the orthogonal ports of an orthopolarization mode transducer, etc. A nonreciprocal quarter wave plate having attached permanent magnets 26 of appropriate length is shown in FIG. 1.

Figure 3E:
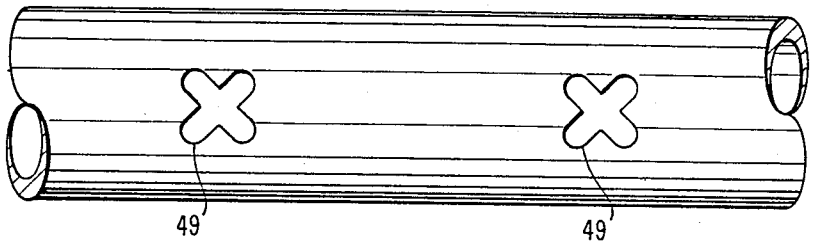
Figure 4A:
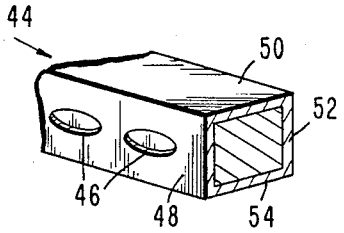
FIG. 4*a* is a perspective view of a cross-section of ferrite filled square waveguide having selected apertures.
Figure 4B:
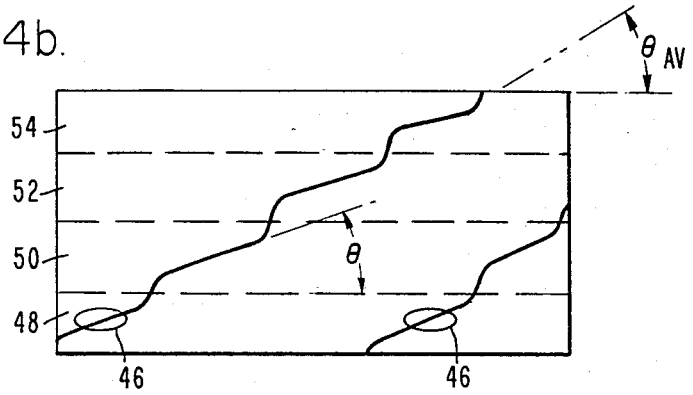
FIG. 4*b* is a chart showing the rf current flow lines of circularly polarized energy through the square waveguide of FIG. 4*a;*

Although the wave is circularly polarized, the field radiated from the apertures 22 will be linearly polarized. The direction of this linear polarization is dependent upon aperture shape and orientation and if relatively thin slots are used, the field will be perpendicular to the slots. If radiating apertures with quadrantal symmetry are used (such as square, circular, or crossed slots), the polarization direction of the radiated field will be parallel to the rf current that the aperture interrupts. FIG. 3*d* presents a pair of circularly shaped apertures 47 formed into the waveguide, which are apertures of quadrantal symmetry while FIG. 3*e* presents a pair of crossed slots 49 formed into the waveguide. Referring to FIG. 4*a*, a cross-section of a ferrite-filled square waveguide 44 with slots 46 is shown. It has four sides identified as 48, 50, 52, and 54. FIG. 4*b* presents a chart of the instantaneous rf current flow in the waveguide walls. The rf currents flow nominally along a square helix, but in the region of the right angle edges of the waveguide 44, the rf current flows perpendicular to the edge. In the center of the waveguide 44 walls, the rf current flows at an angle $\theta$ with respect to the edge of the waveguide in accordance with the following:

$$\tan\theta = \frac{2S}{\lambda_g}$$

where:

S=width of a square waveguide wall $\lambda_g$=wavelength of waveguide

The average or nominal pitch angle in the square waveguide is given by:

$$\tan\theta_{AV} = \frac{4S}{g}$$

The effect of ferrite on a propagating electromagnetic wave is well known to those skilled in the art and is described in U.S. Pat. No. 3,534,374 to R. E. Johnson. It has been found that one of the advantages of fully loading the waveguide 20 with ferrite 21 is that the phase change per free space wavelength is greater than that for a partially loaded waveguide of the same cutoff frequency. Although not intending to be bound by theory, it is believed that the advantageous results of the invention are obtained based on the theory or theories discussed.

In order to cause beam scanning, the permeability of the ferrite is varied by applying a longitudinal magnetic field to it. The change in permeability causes the index of refraction of the ferrite to change. The index of refraction of the ferrite is defined as the ratio of the velocity of a wave in free space to the velocity of a wave in the unbounded ferrite material. Therefore, if the index of refraction in a given thickness of material can be changed, its electrical length will vary and a phase shift will result. The index of refraction n has the following relationship:

$$n = \sqrt{\mu\epsilon}$$

where:

$\mu$=permeability $\epsilon$=permittivity.

The permittivity or dielectric constant of the ferrite remains substantially constant under various magnetic field conditions. The index of refraction, therefore, varies as the square root of the permeability. Upon application of a magnetic field, the permeability of the ferrite varies thus varying the velocity of the wave. Therefore, the radiated beam angle is dependent upon the magnetic field applied to the ferrite and the amount of permeability change possible with the particular ferrite.

As is shown in FIG. 1, the yokes 30 with associated control coils 32 wound around the yokes are attached to the ferrite filled waveguide 20 in the phase shifting section 28 of the antenna 18. The yokes 30 and the control coils 32 are used to impart the required magnetic field to the waveguide ferrite 21. The yokes 30 are typically made of a temperature stable ferrite material.

As in the waveguide ferrite 21, the particular ferrite material used in the yokes 30 can be chosen based on characteristics required for use in holding or latching the magnetic field. Because different ferrite materials may be used for the yokes 30 and the waveguide ferrite 21, each ferrite material may be chosen based on satisfying the requirements of the particular application. This is an advantage over prior techniques where the same ferrite substance is used for phase shifting as well as for holding or latching the magnetic field. Choosing one ferrite material to perform both functions may require a compromise and this may degrade magnetic circuit performance.

The phase shift mechanism used in the invention is a latching type with flux drive to set the phase shift. This is achieved with a voltage × time pulse (flux=voltage × time). In practical applications, the voltage is held constant and the length of the pulse in time is varied. This voltage × time pulse latches the ferrite yoke to the required magnetization for the desired phase setting. Due to the remanent magnetization of the yoke, the magnetization to the waveguide ferrite is latched to the desired value and no holding current is required. Thus, during the time the antenna beam is held in a given direction, there is no drain on the beam control power supply, and since switching time from one beam position to the next is much smaller than the dwell time at any one beam position, there is less control power consumed as compared to prior techniques that require a continuous holding current. Power supplies capable of providing the described drive pulses are well known in the art and are not described herein with greater specificity.

In the invention, latching yokes are practical since the waveguide 20 is completely filled with ferrite 21 and the waveguide wall can be an extremely thin metal on the ferrite itself. The thickness of the metallization is only an rf skin depth or so, which is very thin (on the order of a few thousand angstroms) for good conductors such as silver, gold or copper at microwave and millimeter wave frequencies (approximately $10^{10}$ Hz). This has an advantage in that, so far as microwaves or millimeter waves are concerned, the wall thickness is sufficiently thick that it has substantially the same resistive loss in the waveguide walls as a very thick walled waveguide of the same material. However, it is very thin to the control power frequencies (approximately $10^3$ Hz) whose skin depth for low resistive loss would be about a thousand times as great and consequently, the resistance of the waveguide walls is high to that frequency range. This high resistance to the control power reduces the "shorted turn effect" of the waveguide walls and allows very fast switching time. Another advantage of the relatively thin waveguide wall is that there is essentially no gap in the magnetic flux circuit which includes the latching yoke and phase shifting ferrite.

Figure 5:
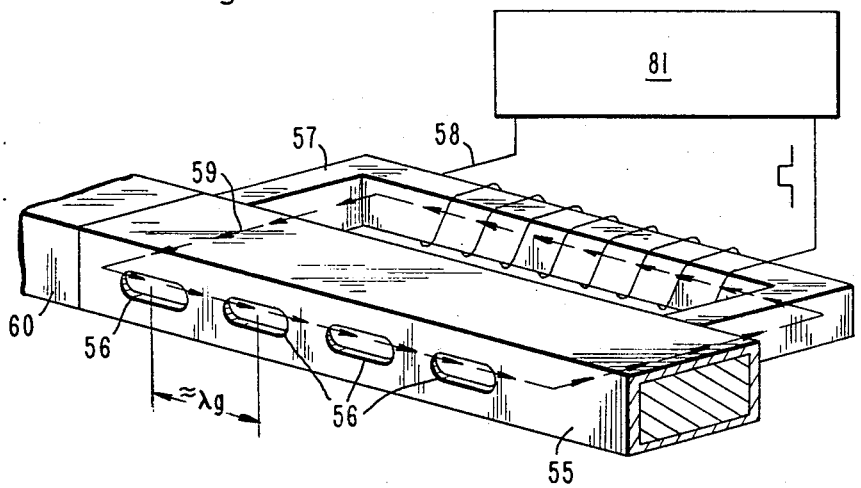
FIG. 5 is a perspective view of part of a scanning antenna constructed in accordance with the invention, showing aperture spacing and the magnetic circuit.

Although shown in FIG. 1 as having two yokes 30, a phase shifting section may be constructed in accordance with the invention wherein one yoke and control coil assembly provides the magnetic flux. This one latching yoke can be placed on any wall of the waveguide. As shown in FIG. 5, the ferrite filled waveguide 55 has apertures 56, a yoke 57, control coils 58 and a pulse generator 81 shown as a block. A convenient wall for the yoke 57 placement would be the wall opposite the radiating apertures 56. In this way the control coils 58 are out of the radiating aperture region so that there is virtually no rf coupling to them. FIG. 5 also schematically shows the magnetic flux 59 circuit through the yoke 57 and the ferrite filled waveguide 55, the nominal one-wavelength spacing (loaded waveguide) between the apertures 56 and an rf load 60.

Devices 34 and 60 shown in FIGS. 1 and 5 respectively are rf loads for increasing the frequency bandwidth of the antenna. Rf loads are well known by those skilled in the art and are not described herein with further specificity.

Figure 6A:
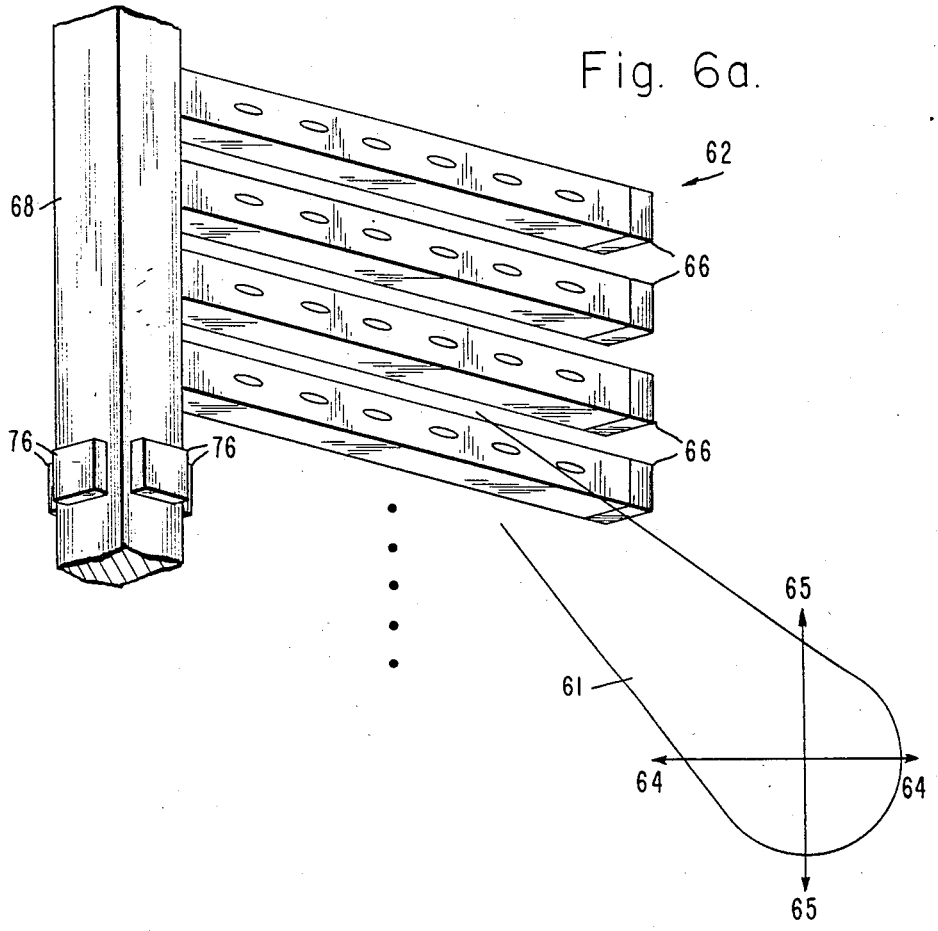
FIG. 6*a* is a partial perspective view of a two dimension scanning array antenna constructed in accordance with the invention.
Figure 6B:
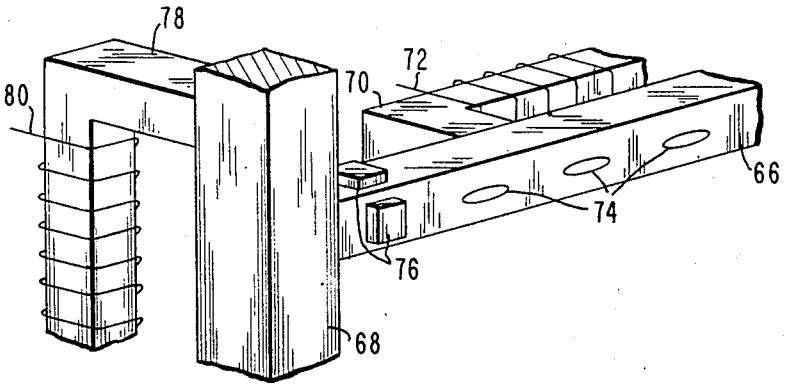
FIG. 6*b* is an enlarged view of part of FIG. 6*a* showing part of a branching waveguide and its relation to the feed waveguide.

The invention has several advantages over prior techniques. One advantage is its ease of fabrication. As previously discussed, a fully ferrite-loaded waveguide with apertures laser cut or etched can be relatively easily fabricated, even for millimeter wavelength energy use. Also, it is accurately and consistently reproduced which makes the invention suitable for use in a planar array type antenna. FIGS. 6*a* and 6*b* present a planar scanning array type antenna in accordance with the invention. FIG. 6*a* diagrammatically shows a narrow pencil beam 61 radiated from the array 62. The beam is electronically scannable in two planes as shown by the arrows 64 and 65. For a two dimensional scanning array antenna such as that diagrammatically shown as 62 in FIG. 6*a*, a plurality of branching elements 66 are combined with a feed element 68. This plurality of branching elements 66 are constructed in accordance with the invention as shown and described previously. The plurality 66 permits scanning the beam in a direction shown by arrows 64. The feed element 68 is likewise an antenna element constructed in accordance with the invention and controls scanning in a direction shown by arrows 65. Its apertures feed the branching elements 66. A more specific view of a part of FIG. 6*a* is shown in FIG. 6*b*. As shown in FIG. 6*b*, the control yoke 70 and control coils 72 are placed on the side of the branching element 66 opposite the radiating apertures 74 thereby avoiding coupling between the radiated rf energy and the control coils 72. Similarly, the control yoke 78 and the control coils 80 of the feed element 68 are placed on the side of the feed element 68 opposite the apertures 74 of the branching element 66. Circular polarizing magnets 76 are shown on the branching element 66 (FIG. 6*b*) and the feed element 68 (FIG. 6*a*).

The ease of fabrication of an antenna in accordance with the invention makes it more desirable than prior arrangements such as the Reggia-Spencer type techniques. In Carlise, ferrite slugs are separated with a dielectric or air. At millimeter wavelength sizes, this fabrication task can be formidable. Furthermore, the fully filled waveguide in the invention is more easily cooled than the Reggia-Spencer type of antenna. In the invention, the ferrite is in contact with the metal waveguide which can dissipate heat by conduction, whereas in the prior technique where a ferrite rod is suspended inside a waveguide, cooling occurs by radiation unless a cooling system is added.

In the invention, a single magnetic field is generated for all the apertures. Due to this uniformity, this approach reduces the possiblity of error. In prior approaches such as the Reggia-Spencer, there is an individual magnetic field generated for each aperture, i.e., there are control windings around the waveguide between each aperture. This raises the problem of obtaining uniformity in magnetic fields for all apertures.

In the invention, the waveguide is fully filled with ferrite thus avoiding the sustaining of higher modes. Furthermore, the invention is capable of two-dimension scanning in an array configuration as shown in FIGS. *6a* and *6b*. The invention has a relatively large scan range and can be continuously scanned through this range. Since the invention operates in accordance with the principles of a dual-mode phase shifter, it has a relatively good figure of merit, is light weight, and is capable of relatively high average power.

Accordingly, there has been shown and described an electronically scanned antenna which is efficient, low cost, simple in construction and has excellent electrical performance. Although the invention has been described and illustrated in detail, it is to be understood that this is by way of example only and is not meant to be taken by way of limitation. Modifications to the above description and illustration of the invention may occur to those skilled in the art; however, it is the intention that the scope of the invention should include such modifications unless specifically limited by the claims. For example, aperture spacing in the ferrite-filled waveguide may be varied in accordance with the beam shape desired. Also, the ferrite-filled waveguide should be chosen to yield the best electrical performance whether that shape be square, circular, corrugated, or other.

What is claimed is:

1. An array antenna for spatially scanning a beam of electromagnetic energy, comprising:

an end fed waveguide with a plurality of apertures formed therein;

a continuous ferrite rod disposed within the waveguide, and along a length thereof, the length including a plurality of apertures;

magnetic field means for applying a longitudinally oriented magnetic field through the ferrite rod, the magnetic field being applied across the waveguide and outside of the region of the scanning beam; and polarizing means for circularly polarizing electromagnetic energy which tranverses the waveguide.

2. The array antenna of claim 1 wherein the ferrite rod fully fills the waveguide along the length.

3. The array antenna of claim 2 wherein the apertures are formed in the waveguide at intervals from each other of substantially one wavelength, the one-wavelength as determined by energy propagation through the ferrite rod.

4. The array antenna of claim 2 wherein the magnetic field means comprises:

at least one control yoke coupled to the ferrite rod; and an electrical conductor coiled around the at least one control yoke for conducting electricity therethrough to establish a magnetic field in the control yoke.

5. The array antenna of claim 4 further comprising a drive pulse applied to the electrical conductor for establishing a magnetic field in the at least one control yoke.

6. The array antenna of claim 5 wherein the drive pulse comprises a selected fixed voltage with a variable pulse time.

7. The array antenna of claim 4 wherein the at least one control yoke is coupled to the ferrite rod opposite the waveguide apertures.

8. The array antenna of claim 4 wherein the wall thickness of the waveguide is such that the waveguide presents a small resistive loss to the electromagnetic energy but presents a high resistive loss to electricity applied to the electrical conductor.

9. The array antenna of claim 2 wherein the construction of the waveguide comprises forming a layer of electrically conductive material on the ferrite rod.

10. The array antenna of claim 9 wherein the construction of the plurality of apertures comprises cutting through the layer of electrically conductive material.

11. The array antenna of claim 2 further comprising an rf load means coupled to the opposite end of the waveguide from the feed ehd, for absorbing rf energy.

12. An array antenna for spatially scanning a beam of electromagnetic energy, comprising:

an end fed waveguide with a plurality of apertures formed therein;

a continuous ferrite rod disposed within and fully filling the waveguide along a length thereof, the length including a plurality of apertures;

polarizing means for circularly polarizing electromagnetic energy which traverses the waveguide;

at least one control yoke coupled to the ferrite rod for applying a longitudinally oriented magnetic field through the ferrite rod; and an electrical conductor coiled around the at least one control yoke for conducting electricity therethrough to establish a magnetic field in the at least one control yoke.

13. The array antenna of claim 12 wherein the apertures are formed in the waveguide at intervals from each other of substantially one wavelength, the one wavelength as determined by energy propagation through the ferrite rod.

14. The array antenna of claim 12 wherein the wall thickness of the waveguide is such that the waveguide presents a small resistive loss to the electromagnetic energy but presents a high resistive loss to electricity applied to the electrical conductor.

15. The array antenna of claim 12 wherein the shape of the apertures is selected from the group consisting of a narrow slot, a crossed slot and an aperture of quadrental symmetry.

16. The array antenna of claim 12 further comprising a drive pulse applied to the electrical conductor for establishing a magnetic field in the at least one control yoke.

17. The array antenna of claim 16 wherein the drive pulse comprises a selected fixed voltage with a variable pulse time.

18. The array antenna of claim 12 wherein the at least one control yoke is coupled to the ferrite rod opposite the waveguide apertures.

19. The array antenna of claim 12 wherein the cross-sectional shape of the waveguide is selected from the group consisting of circular and rectangular including square.

20. The array antenna of claim 12 further comprising an rf load means coupled to the opposite end of the waveguide from the feed end, for absorbing rf energy.

21. The array antenna of claim 12 wherein the construction of the waveguide comprises forming a layer of electrically conductive material on the ferrite rod.

22. The array antenna of claim 21 wherein the construction of the plurality of apertures comprises cutting through the layer of electrically conductive material.

23. The array antenna of claim 12 wherein:

the plurality of apertures comprises at least one radiating aperture oriented such that it interrupts the rf current flow of desirable electromagnetic energy which traverses the waveguide and which is to be radiated;

the plurality of apertures comprises at least one coupling aperture oriented such that it interrupts the rf current flow of undesirable electromagnetic energy which traverses the waveguide and which is not to be radiated; and further comprising an rf load means for absorbing the undesirable electromagnetic energy coupled out of the waveguide by the at least one coupling aperture.

24. The array antenna of claim 23 wherein:

the at least one radiating aperture has the shape of a narrow slot and is oriented such that the long dimension of the narrow slot is substantially parallel to the rf current flow of the undesirable electromagnetic energy;

the at least one coupling aperture has the shape of a narrow slot and is oriented such that the long dimension of the narrow slot is substantially parallel to the rf current flow of the desirable electromagnetic energy;

whereby the at least one radiating aperture does not radiate the undesirable electromagnetic energy and the at least one coupling aperture couples it into the rf load means.

25. An array antenna for scanning a beam of electromagnetic energy in two dimensions, comprising:

(a) a feed element for scanning the beam of electromagnetic energy in a first direction, comprising:

(i) a first end fed waveguide with a plurality of apertures formed therein;

(ii) a first continuous ferrite rod disposed within and fully filling the first waveguide along a length thereof, the length including a plurality of apertures;

(iii) first polarizing means for circularly polarizing electromagnetic energy which traverses the first waveguide;

(iv) first magnetic field means for applying a longitudinally oriented magnetic field through the first ferrite rod; and (b) a plurality of branching elements operatively coupled to the plurality of apertures of the feed element, for scanning the beam of electromagnetic energy in a second direction, comprising:

(i) a second end fed waveguide with a plurality of apertures formed therein;

(ii) a second continuous ferrite rod disposed within and fully filling the second waveguide and along a length thereof, the length including a plurality of apertures;

(iii) second polarizing means for circularly polarizing electromagnetic energy which traverses the second waveguide; and (iv) second magnetic field means for applying a longitudinally oriented magnetic field through the second ferrite rod.

26. The array antenna of claim 25 wherein the first and second waveguides are of circular cross section.

27. The array antenna of claim 25 wherein the first and second waveguides are of square cross section.

28. The array antenna of claim 25 further comprising:

a first rf load means coupled to the opposite end of the first waveguide from the feed end, for absorbing rf energy; and a second rf load means coupled to the opposite end of the second waveguide from the feed end, for absorbing rf energy.

29. An apparatus for separating circularly polarized electromagnetic energy of opposite senses, comprising:

an end fed waveguide to which the circularly polarized electromagnetic energy is applied, having a plurality of narrow slot apertures formed therein;

a continuous ferrite rod disposed within and fully filling the waveguide along a length thereof, the length including a plurality of apertures;

at least one aperture oriented so that it interrupts the rf current flow of the electromagnetic energy of a first sense; and at least one aperture oriented so that it interrupts the rf current flow of the electromagnetic energy of a second sense;

whereby electromagnetic energy of the first sense is coupled out at least one slot and electromagnetic energy of the second sense is coupled out a different at least one slot.

30. The apparatus of claim 29 further comprising:

rf load means for absorbing the electromagnetic energy of the second sense which is coupled out of the waveguide by the associated at least one aperture;

whereby electromagnetic energy of the first sense is radiated while electromagnetic energy of the second sense is absorbed.

* * * * *